United States Patent [19]

Langer, nee Layher

[11] Patent Number: 4,952,114

[45] Date of Patent: Aug. 28, 1990

[54] DEVICE FOR TRANSPORTING ADJUSTING FRAMES FOR SCAFFOLDING

[76] Inventor: Ruth Langer, nee Layher, IM Weinberg 13, D-7129 Gueglingen (Baden-Wuerttermberg), Fed. Rep. of Germany

[21] Appl. No.: 322,164

[22] Filed: Mar. 13, 1989

[30] Foreign Application Priority Data

Mar. 11, 1988 [DE] Fed. Rep. of Germany .... 3808098.2

[51] Int. Cl.[5] ..... B66F 9/06

[52] U.S. Cl. ..... 414/608; 182/63

[58] Field of Search ..... 414/608, 607; 108/85.1, 108/55.3; 182/63, 179

[56] References Cited

U.S. PATENT DOCUMENTS

| | | | |
|---|---|---|---|
| 2,917,261 | 12/1959 | Stough | 108/55.1 |
| 2,947,565 | 8/1960 | Wood | 108/55.3 X |
| 3,168,060 | 2/1965 | Farley | 108/55.1 X |
| 3,590,752 | 7/1971 | DePew | 108/55.3 |
| 3,782,498 | 1/1974 | Gleisen | 182/179 X |
| 4,286,913 | 9/1981 | Rowe et al. | 414/608 X |
| 4,411,367 | 10/1983 | Bustos | 414/608 X |

*Primary Examiner*—David A. Bucci

*Attorney, Agent, or Firm*—Antonelli, Terry, Stout & Kraus

[57] ABSTRACT

A conveying system for trestle frames of scaffolds to be utilized and transported as well as stored in an upright position. The conveying system included holding rails of a rack-like structure, with the rails being arranged in pairs and engaging with teeth thereof beside ends of scaffold tubes and, respectively, lower cross connections of the trestle frames. The conveying system also includes lower holding rails provided with receiving recesses for cross connections of the trestle frames. The trestle frames can readily be threaded in place and the transport pallets can be taken up by forks of forklift truck through apertures provided in the trestle frame, with the apertures enabling the forks to be inserted in the longitudinal and transverse directions thereby facilitating handling and transportation of the transport pallets by forklift trucks.

40 Claims, 8 Drawing Sheets

DEVICE FOR TRANSPORTING ADJUSTING FRAMES FOR SCAFFOLDING

BACKGROUND OF THE INVENTION

The present invention relates to a conveying system and, more particularly, to a conveying system for transportation and storage of trestle frames of scaffolds, to be utilized in the upright position, with a lower platform-like frame of sheet steel or the like having receiving openings for the forks of forklift trucks, and with holding means for the trestle frames.

Parts of scaffolds have long been stored and transported essentially in a prone position on holding devices of the type of transport platforms or transport pallets by perpendicularly extending fixation elements. With such a storage and transportation, the holding devices can be picked up by forklifts and transferred, or can be transferred in a suspended condition with other hoisting means with the aid, for example, ropes, chains, or the like. This type of storage and conveyance is also used for trestle frames designed as coherent frames of certain scaffolding systems. In these structures, respectively two scaffold poles to be placed vertically are combined into the trestle frame by an upper cross connection supporting the scaffold floor, and a lower cross connection which normally also prevents a lifting off of the scaffold floors and, optionally, these poles are provided with further auxiliary means. Such trestle frames are of a relatively large weight and during and assembly and disassembly of the scaffolding at a building site, considerable use of force is required by scaffold assemblers who perform this work exclusively manually.

To facilitate labor and to render transportation and storage more practical in, for example, DOS No. 3,536,914.0 A 1, a conveyance platform construction is proposed which includes plug-in receptacles for the tube ends of trestle frames. In this arrangement, vertically projecting tenons or pipes are provided into which the toothed ends of the trestle frames are threaded, or onto which the open tube ends are placed. This proposed construction has not become too popular because the threading operation is very difficult.

It has also been verbally suggested to include a profiled rails of a certain minimum thickness to be equipped with bores and arranged mutually in pairs above the profile frame of the transport pallet, and to be connected to the transport pallet. The steel tube posts or trestle frames are then to be passed with their tube ends through the rail bores until they rest with their tube ends on the steel profile frame. However, this suggestion does not lead itself to practical realization since here again a threading operation is required which demands a great amount of skill because the plug-in receptacles must be adapted with relatively high accuracy to the tube diameter so that the trestle frames are held perpendicularly in the plug-in receptacles. Additionally, this theoretical suggestion does not take into account the cross connections of the trestle frames in the lower zone.

Due to the great weight of each individual trestle frame, threading of the ends of the trestle frame tubes into the openings or placing such tubes onto tenons is difficult and requires a great amount of retaining force during this operation. The provision of closed openings and, respectively, the attachment of a large number of tube ends or pins requires considerable manufacturing expenditure or suitable expensive welding devices. Although the conveying platform is equipped with plug-in and retaining means for forks of forklifts, the proposed constructions are merely such that the forks are to be inserted from one side. Loading onto trucks and practical stacking in storage sheds and carrying to building sites require the receptacles for the forks of forklift trucks be disposed in such a manner that they can be engaged not only from opposite sides.

In, for example, French reference No. A1 2,285,308, a frame work especially for intra-company transportation and storage of workpieces to be machined such as shafts with gear wheels and the like is proposed which includes corner columns with auxiliary stacking means and laterally extending, horizontal stringers. The stringers include perforations on one side thereof extending in a horizontal surface into which ends of workpieces can be placed. On the other side, a holding rail is mounted which includes upwardly open recesses at relatively large mutual spacings, with the recesses being engaged by partial areas of the elongated workpieces, such as shaft ends and the like, which are supported on the other side. This proposed arrangement is not suitable for vertical placement of trestle frames for scaffolds, and does not yield any suggestions in this respect.

DOS No. 2,033,514 proposes a process and apparatus for building of rooms, especially a living space, wherein entire building walls are transported. For this purpose, insert mountings are provided for vertical retention, satisfying the conditions in case of especially heavy building components. Such building components cannot be retained, or at least not alone, in the region of the bottom end. In this respect, the auxiliary means dealt with therein are unsuitable for an orderly depositing of trestle frames of scaffolds in conveying means of the type provided for by the present invention.

The aim underlying the present invention essentially resides in providing a conveying system for trestle frames wherein the trestle frames can be inserted and securely retained in an easy manner, within a short period of time, and with a minor expenditure of lifting force, and wherein the manufacture thereof is possible from parts that can be easily worked and with little expenditure.

According to advantageous features of the present invention, holding means for the upright retention of the trestle frames are formed by rack-shaped holding rails arranged in pairs and engaging with their teeth beside the lower tube ends and, respectively, the lower cross connections of the trestle frames, wherein the lower holding rails lie within the tube ends and the lateral rack rails with inwardly pointing lateral rack teeth lying there above at a suitable distance of preferably about 12–25 cm are located so that the inner spacing of the holding recesses corresponds to the outer spacing of the scaffold poles of the trestle frames.

A thus constructed transport system in the form cf a conveyor pallet is built up of a few parts and formed in a simple manner by punching, bending, chamfering and/or rolling and welded together in s simple, fast and secure fashion. By virtue of a low expenditure for material and a relatively low weight, this transport system exhibits great stability and, above all, permits rapid introduction of a plurality of trestle frames, to be used in upright condition, into its holding device, a removal of such frames quickly from such devices, installation of the same in the same position, and also makes it possible to transfer these frames in a relatively large number by suitable transport units to locations where they are needed or where they are supposed to be stored.

Moreover, with this arrangement, the troublesome threading operations are eliminated, and the trestle frames can be sensibly transported just as other scaffold components and can be maintained ready together with the other scaffold components or can be stored therewith.

In accordance with further features of the present invention, holding means are included for the inserted trestle frames, with the holding means being movable over the cross connections and lying with their lower holding surfaces at a spacing above the supporting faces of the holding rails corresponding to the height of top edges of the lower cross connections of the inserted trestle frames. Thereby the trestle frames can be firmly connected with the conveying system after insertion so that the entire parcel of trestle frames and conveying systems can be suspended in an upper zone on a hoisting unit such as, for example, a crane or the like and, consequently, stable transport conditions are realized.

In accordance with still further advantageous features of the present invention, the lower holding rails are bent upwards along inner edges of holding and guide plates extending up to longitudinal sidewalls and running substantially horizontally, with the bottom surfaces thereof extending at a level of the top edges of the recesses for accommodating the forks of a forklift. Thereby, in addition to lending great stability to the entire transport system, the introduction of the forks of the forklifts is substantially facilitated because the forks cannot get caught at the edges of openings formed freely out of the surface areas.

Advantageously, in accordance with the present invention, the holding teeth of the lower holding rails are fashioned as rectangular tenons formed by punching out holding recesses along rims of vertically extending inner walls of the longitudinally extending supports.

Preferably, the upper lateral holding rack rails are fashioned as separately produced longitudinal support components bent into U-shaped profiles or formed from U-shaped profiles, with the upper horizontal legs being constructed as later rack rails that are open toward an inside of the trestle frame and provided with closely just opposed holding recesses shaped as semicircles or divided circles having a diameter corresponding substantially to a diameter of the scaffold poles.

In accordance with still further features of the present invention, the upper end holding plates are welded with their lower lateral end zones at the end phase in front of the lower longitudinal supports and are welded in the zone of there upper outward corners at an end face in front of the upper profile holding rails.

Advantageously, according to the present invention, vertical connectors are provided between the lower longitudinal supports and the upper profile holding rails, with the upper and holding plates including, in a region of there ends, perforations for enabling engagement with at least one of hooks, ropes, and chains. Advantageously, the upper holding plates include recess means in a center thereof for reducing a weight thereof and at least a central grasping apentive for enabling a manual transport.

Advantageously, at least one identically central cross support is provided at a distance from lower cross struts provided at the respective ends of the longitudinally extending supports, with a distance corresponding to a length of forks of the forklifts.

In accordance with the present invention, the longitudinally extending supports include preferably in an outward bottom zone respectively one longitudinally extending outwardly rounded supporting rib formed by a double bending. Advantageously, a top portion of outer walls of each of the longitudinal supports include reinforcing legs that are bent twice toward an inside of the longitudinal supports.

Furthermore, in accordance with the present invention, holding means are provided for the inserted trestle frames which can be placed over the cross connections and which lie with their lower holding surfaces above the supporting faces of the lower holding rails at a predetermined distance corresponding to a height of the upper edges of the lower cross connections of the inserted trestle frames.

Advantageously, the holding means are constituted by holding bars extending through the transport pallet in the direction of the lower holding rails and the upper lateral holding rack rails.

Bearing bores are provided for accommodating ends of the holding bars, with the bearing bores being formed in the inside walls.

According to the present invention, the holding bars include at both ends thereof safety hooks which are bent so as to point in opposite directions, with the bearing bores being formed in the inside walls as horizontally extending slotted holes having a size sufficient to accommodate the safety hooks.

According to the present invention, the lower holding rails are bent upwardly on the inner edges of holding and guide rails extending up to the longitudinal side walls and running substantially horizontally, their bottom surfaces extending at a level of the top edges of the fork cutouts.

The longitudinally extending sidewalls include, in accordance with the present invention, at upper edges thereof the inwardly directed lateral rack teeth and at lower edges thereof bent-away bottom supporting legs, with the holding and guide plates being welded in place directly above the fork cutouts.

Preferably, according to the present invention, the end side walls are inserted between end side legs bent at an end side away from the longitudinal side walls and are welded to these legs.

Advantageously, according to the present invention, the transport pallets are provided in the edge and/or corner areas of the upper and/or lower surfaces with stacking aids for the empty state, with the aids being adapted to be brought in too mutual engagement in the vertical direction and positively preventing lateral movement.

Additionally, according to still further features of the present invention, retaining means for holding the frames in the standing or upright positions are constructed combwise and engage both onto and into from the outside and they are constructed, over a length that prevents tipping as a tilt preventer engaging the frame from below.

The above and other objects, features, and advantageous of the present invention will become more apparent from the following description when taken in connection with the accompanying drawings which show, for the purpose of illustration only, several embodiments in accordance with the present invention.

DETAILED DESCRIPTION

Figure 1:
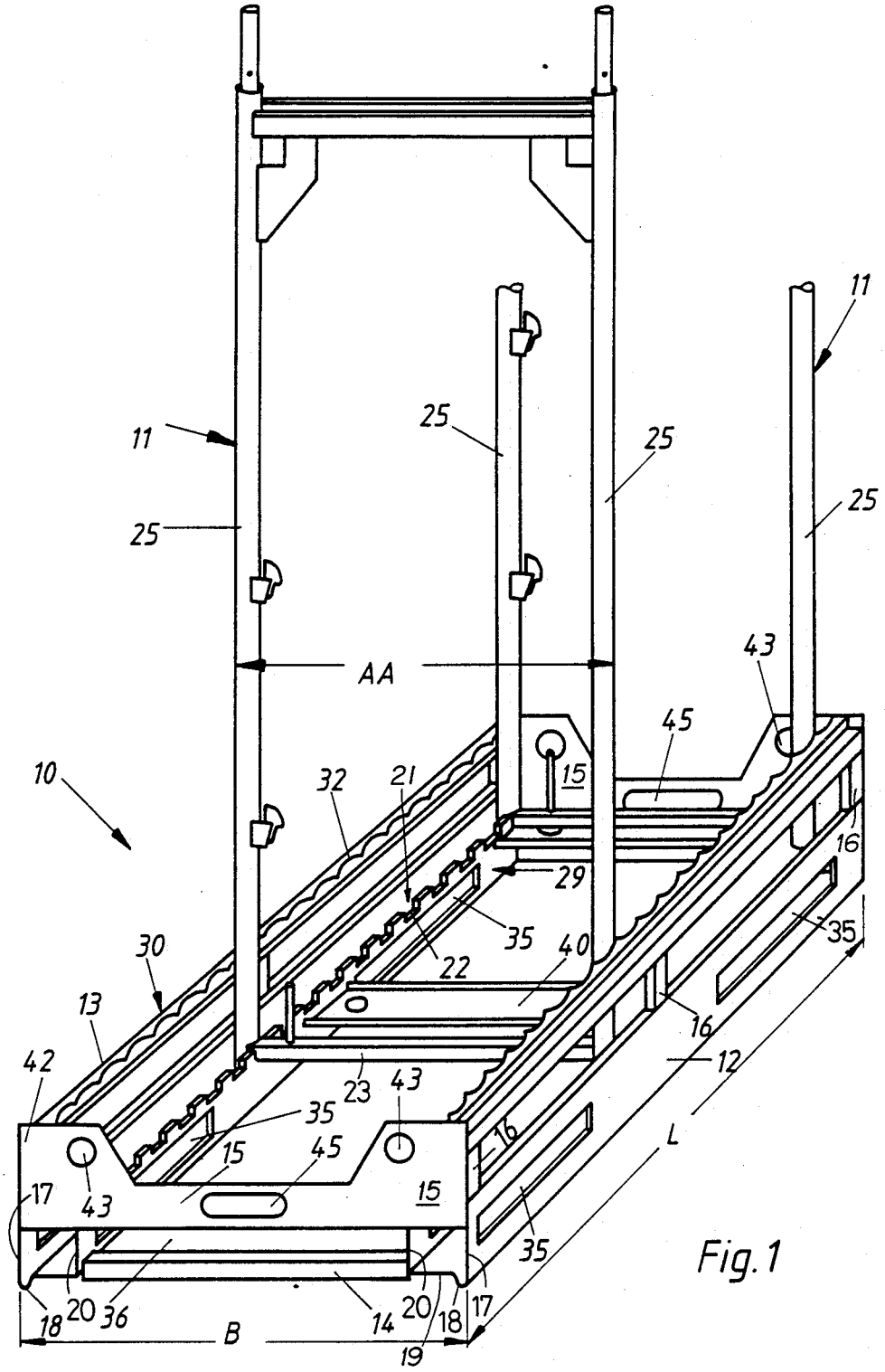
FIG. 1 is an oblique perspective view of a first embodiment of the present invention of a transport pallet with two inserted trestle frames.

Referring now to the drawings were in like reference numerals are used throughout the various views to designate like parts and, more particulary, to FIGS. 1–5, according to these figures, transport pallets generally designated by the reference numeral 10 for the upright reception of trestle frames generally designated by the reference numeral 11 are fashioned in the manner of frames and are of such dimensions that they can be picked up by a forklift and can also be deposited side-by-side on a truck or trailer (not shown). The trestle frame 11 has an outside width B about 80–85 cm and a length L of about 120 cm so as to accommodate twenty trestle frames 11. However, it is understood that different dimensions are likewise possible with the dimensions only being limited by taking into account sensible practical handling of the transport pallets 10.

This is possible because the retaining means to hold the frames in the standing position are designed combwise, engaging against and in from the outside, such that they are designed, over a length that prevents tipping, as a tilt preventer engaging the frame from below.

The transport pallets 10 include lower longitudinal supports 12, upper profiled holding rails 13, lower cross struts 14, upper end holding plates 15, and vertical connectors 16. All of the components or elements are manufactured from bent steel sheet or rolled profile members, welded together, and then galvanized. While the components or elements may also be fashioned of light metal profiles, the following description will deal only with steel sheet construction.

The lower longitudinal supports 12 each include a vertically disposed outer wall 17 formed by being twice beveled toward an inside at the bottom into a supporting rib 18. The supporting rib 18 is followed by the horizontal wall 19, lying thereby at a small distance from a floor or support surface. The horizontal wall 19 passes over into an inner wall 20 which is bent at a right angle in the upward or vertical direction.

An upper rim generally designated by the reference numeral 21 (FIG. 2) of the inner wall 20 is provided with engaging recesses 22 for the lower cross connections 23 of the trestle frames 11 so that the holding teeth 24 remain standing or vertically directed. In the illustrated embodiment, a rectangular cross section has been selected for the engaging recesses 22 and the holding teeth 24, since the cross connections 23 are formed, in case of the trestle frames of the preferred embodiment, from flat-lying rectangular profile tube. Depending on the construction of the trestle frames 11 and their lower cross connections 23, it is also possible to select rounded engaging recesses and correspondly rounded or pointed teeth.

The profiled shape of the upper rim 21 as well as a lower holding rail general designated by the reference numeral 29 permits ready threading and secure retention and can be realized easily and inexpensively by simply punching out the upper rim 21. The length of the holding teeth 24 is selected so that the lower cross connections 23 cannot jump out in an upward or vertical direction even in the case of vibrating or shaking motions due transportation over to, for example, uneven roadways. The spacing of the outer wall 17 and the inner wall 20 is selected so that the inner wall 20 lies with the upper rim 21 within the cylindrical scaffold poles 25, formed from tubes, of the trestle frames 11. In the illustrated embodiment, a suitable clearance must be established because fixation against displacement in the plane of the trestle frames 11 is effected at the top.

Figure 2:
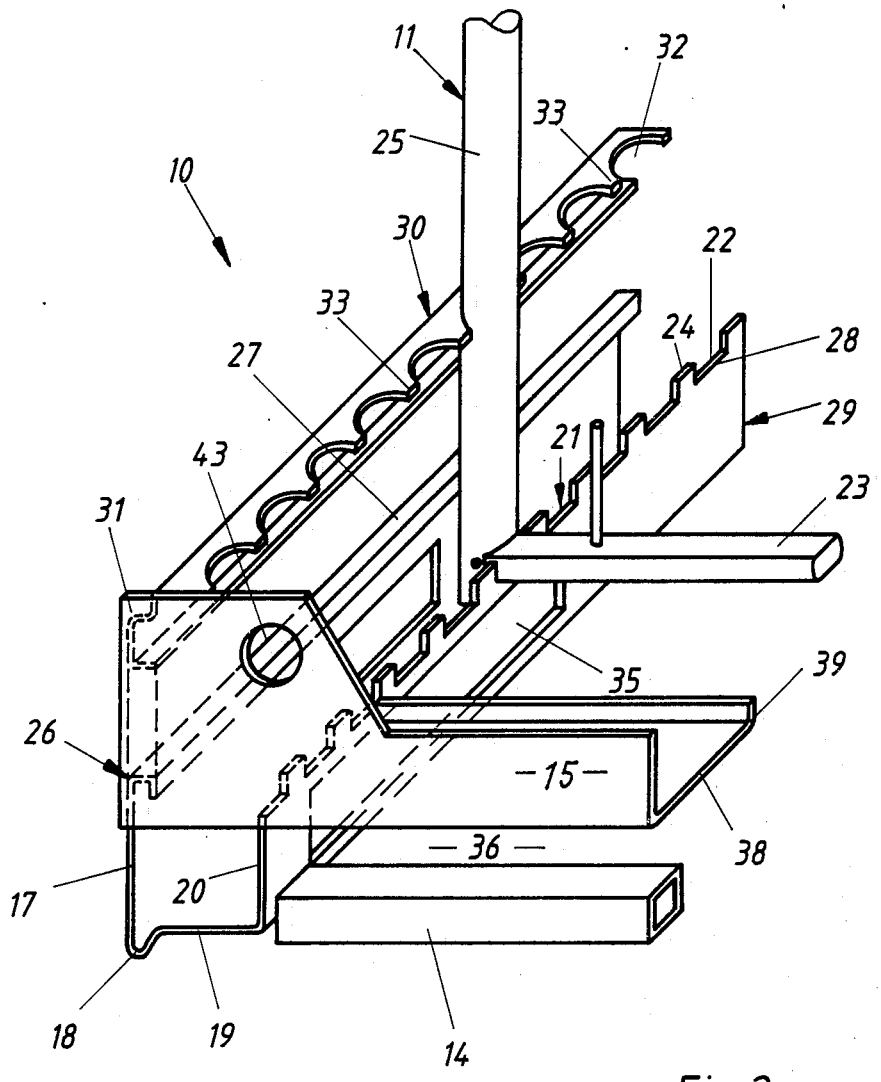
FIG. 2 is an enlarged oblique perspective view of a corner portion of the transport pallet of FIG. 1 with a bottom corner of a trestle frame.

As shown in FIG. 2, a top rim generally designated by the reference numeral 26 of the outer wall 17 is formed by double bending into a reinforcing leg 27 so that the outside wall 17 is solid, and no injuries can be substained during handling.

An upper lateral toothed or rack rail general designated by the reference rail 30 of the upper profile rail 13 is located at a distance A (FIG. 4) of about 190 mm above the supporting surfaces 28 (FIG. 2) of the engaging recesses 22. The upper lateral toothed or rack rail 30 is fashioned, as shown most clearly in FIGS. 2 and 4, as a profiled rail bent approximately into a L-shape and provided with a fold 31 so that a stiff bottom U-shaped profile in prone position results, with the upper lateral toothed or rack rail 30 being formed directly adjacent to this profile in such a manner that the holding or engaging recesses 32 formed at the rim are exposed unimpeded by the remaining construction.

In the above described arrangement, the holding or engaging recesses 32, having the shape of a semicircle or divided circle are provided in a uniformed distribution over an entire length of the upper lateral toothed or rack rail 31 and in relatively close juxtaposition so that the lateral rack teeth 33 of the upper lateral toothed or rack rail 30 are formed therebetween, with the teeth 33 being engagable between the scaffold poles 25 to laterally fix the same in their position. The lateral rack teeth 33 are constructed with such a width that it is readily possible to extend one's fingers between the scaffold posts 25. There is no need for any greater amount of clearance between the trestle frames 11 unless one must consider components that protrude laterally beyond the scaffold poles 25.

An inner spacing IA (FIG. 3) of the engaging recesses 32 corresponds to an outer spacing AA (FIG. 1) of the scaffold poles 25 of the trestle frames 11 plus a small thread-in clearance. Thus, a first trestle frame 11 can be inserted beginning at one end of the transport pallet 10 in the first engaging recess 32 with a bottom end of a scaffold pole 25, but otherwise standing with a somewhat oblique orientation, so that the frame is fixed in two directions. In this fixed position, by pivoting approximately along a circular path, the associated engaging or holding recess 32 can then be searched for on the other side of the upper lateral rack or toothed rail 30, and the lower end of the associated scaffold pole can be allowed to enter therein. At this point, the trestle frame 11, fixed in place with respect to two planes, is lowered until the bottom cross connection 23 has reached a zone of the upper ends of the holding teeth 24. By a slight pivoting of the trestle frame 11 in the fixation between the two mutually facing holding recesses 32, it is possible very easily and with the expenditure of very little holding force to find the associated receiving recesses 22 in the lower holding rails 29, and to lower the bottom cross connection 23 into the engaging or holding recesses 22 down to the supporting surfaces 28. In this manner, a trestle frame 11 has been introduced and retained in a very easy and simple fashion and with security. The subsequent trestle frame 11 is hung or suspended in place in a corresponding fashion. Thus, the trestle frames 11 taken in upright position from the scaffold to be taken down can be inserted without pivoting action in the transport pallet 10, brought to another location, and at that point withdrawn again easily and quickly in the upright position.

For transportation purposes, recesses are provided in all four longitudinal sides and transverse sides for introduction of forks of the forklift unit.

For this purpose, as shown most clearly in FIG. 1, the lower longitudinal supports 12 include two mutually spaced-apart, flat fork cutouts 35 extending approximately up to the ends, with each cutout extending through the outer wall 17 and the inner wall 20 of the lower longitudinal extending supports 12.

For enabling an introduction of the forks from the narrow end faces, the cross struts 14 extending to the bottom are arranged with a fork spacing GA (FIG. 4), for example, a spacing corresponding to a thickness of the forks of forklift trucks, beneath the bottom edges 37 of the end holding plates 15 so that fork apertures 36 result over an entire width between the inner walls 20 of the lower longitudinal supports 12. As shown in the drawings, the cross struts 14 are constructed as flat-positioned rectangular pipes or square pipes welded in place at a bottom between the inner walls 20 of the lower longitudinal supports 12.

Figure 3:
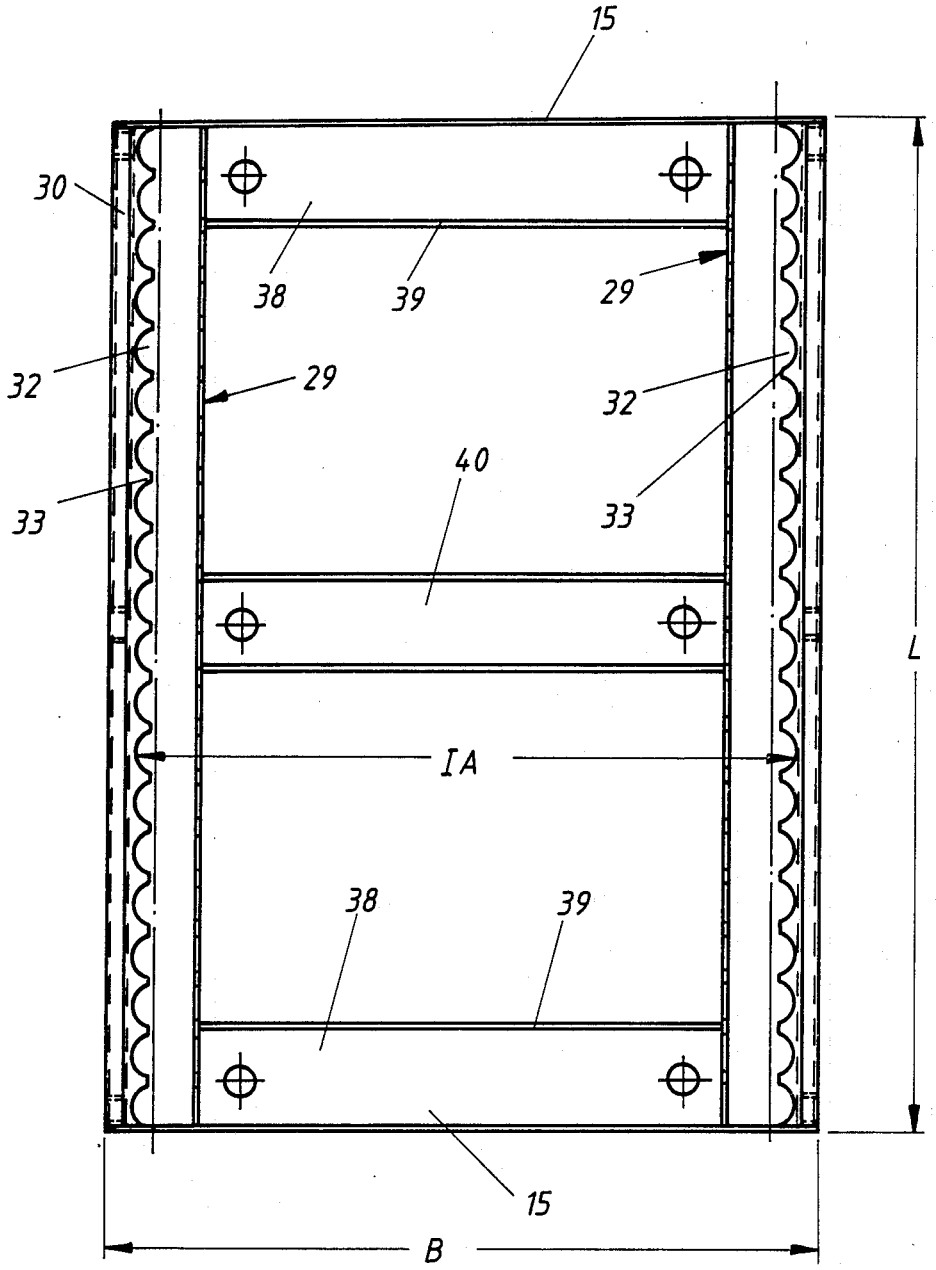
FIG. 3 is a top view of a transport pallet of FIG. 1 and 2 without inserted trestle frames.
Figure 4:
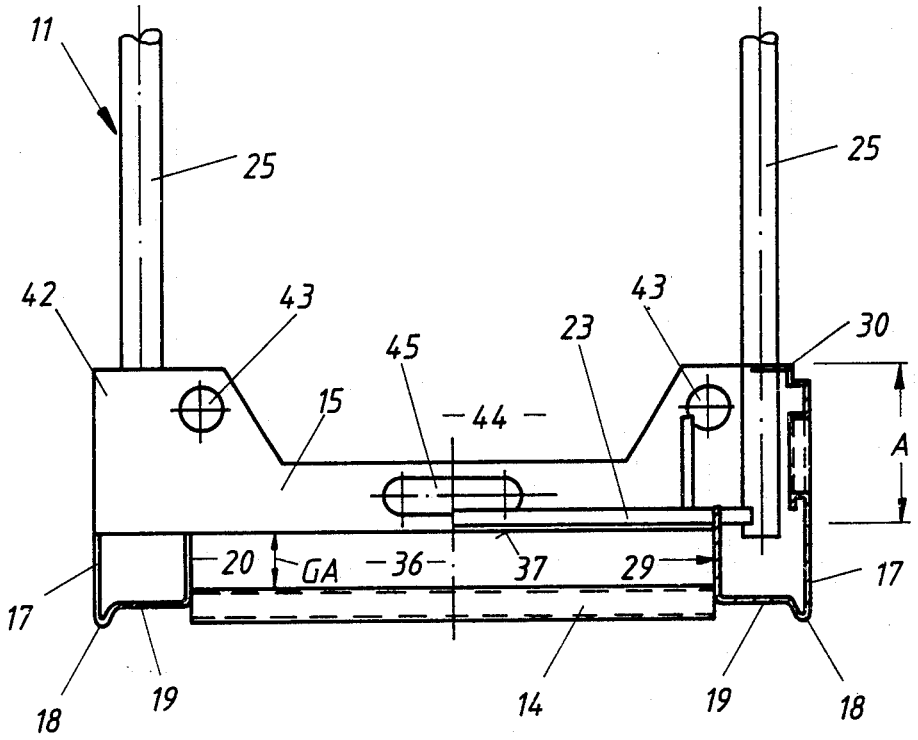
FIG. 4 is a partial cross sectional end view of the transport pallet of FIGS. 1–3 with an inserted trestle frame, with the right-hand half portion thereof being shown in cross-sections.
Figure 5:
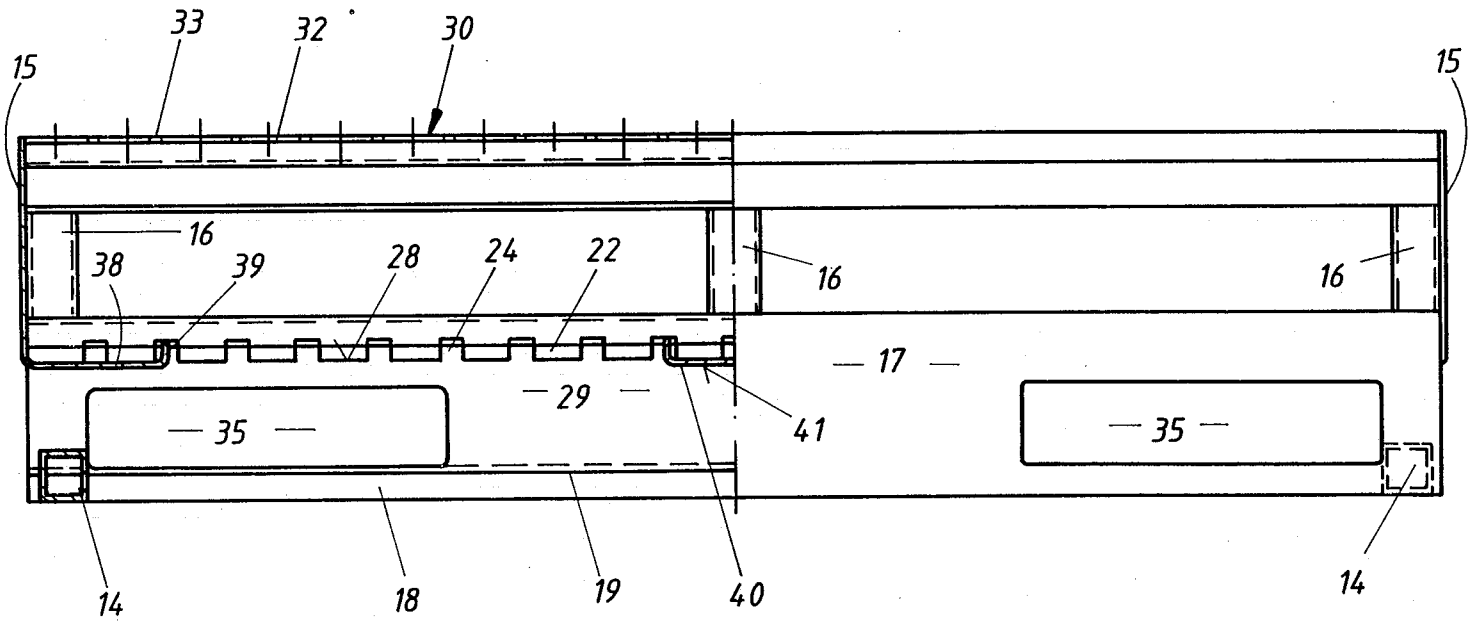
FIG. 5 is a partial cross-sectional longitudinal lateral view of the transport pallet of FIGS. 1–4 without an inserted trestle frame.

The end holding plates include, at a bottom thereof, inwardly bent fork supporting legs 38 provided at their inner ends with upwardly bent reinforcing legs 39, as shown most clearly in FIGS. 3 and 4.

Approximately in a region of a longitudinal center of the transport pallet 10, in any event at a spacing or distance from the respective upper end holding plate 15 corresponding to the length of forks of the forklifts, a central transverse support 40 is provided which is welded, in the form of a short-legged U-shaped profile, in a trough-like manner between the upper rims 21 and the inner walls 20 of the lower longitudinally extending supports 12. In the case of longer transport pallets 10, several cross supports 40 can be welded in place. A lower supporting surface 41 (FIG. 5) lies at the same level as the bottom edge 37 of the end holding plates 15 so that the transport pallet is here supported on the forks at a uniform distance with respect to the floor or support surface; whereas, during insertion in a transverse direction, the upper rims of the fork cutouts rest thereon.

In the zone of the upper corners 42 of the end holding plates 15, round perforation 43 are provided, for example, at this location on all four corners for engagement with, for example, hooks, ropes, chains or the like, for lifting by hoisting units such as, for example, cranes or the like. Furthermore, the end holding plates 15 are provided in the region of the center with trapezoidal recesses 44 (FIG. 4) for weight reduction. Also, respectively one grasping aperture 45 is provided for manual transport and is arranged in the middle of the end holding plates 15.

FIGS. 6–9 illustrate another embodiment of a substantially identical conveying system in the form of a transport pallet generally designated by the reference numeral 50 with the lateral rack rails 30 being of the same structure and operating in the same fashion, as the embodiments of FIGS. 1–5, except that they are formed as sheet metal parts shaped in a different manner and more sensibly for some purposes. Additionally, a safety feature is provided against removal of the trestle frames 11 so that the entire pack or parcel of trestle frames 11 plus the transport pallet 50 can also be engaged at the upper ends of the trestle frames 11 by hoisting units, such as, for example, cranes or the like, and can be lifted.

If no frames 11 are inserted in transport pallets 10, they can be stacked well and safely, with the supporting ribs 18 of the transport pallet 10 that happens to be on top, engaging the two lateral grooves 31 on the top of the transport pallet 10 that is below it. The ends of outside walls 17 and/or support ribs 18 between the outer corners of the upper end retaining panel 15 abut the transport pallets 10 located beneath to prevent axial shifting, while transverse shifting is accomplished by the engagement of support ribs 18 in grooves 31.

In the transport pallet 50, two longitudinal sidewalls 51.1 and 51.2 are provided which are equipped on all four edges with angled legs, with the upper inwardly angled legs forming the lateral rack rails 30. The lower, also inwardly angled legs are fashioned as bottom support legs 52.1 and 52.2. The two other legs are end side legs 53.1–53.4 serving for abutment purposes and for attachment of the end sidewalls 54.1 and 54.2 which are inserted from the inside and welded in place and the manner illustrated in the drawings.

Figure 7:
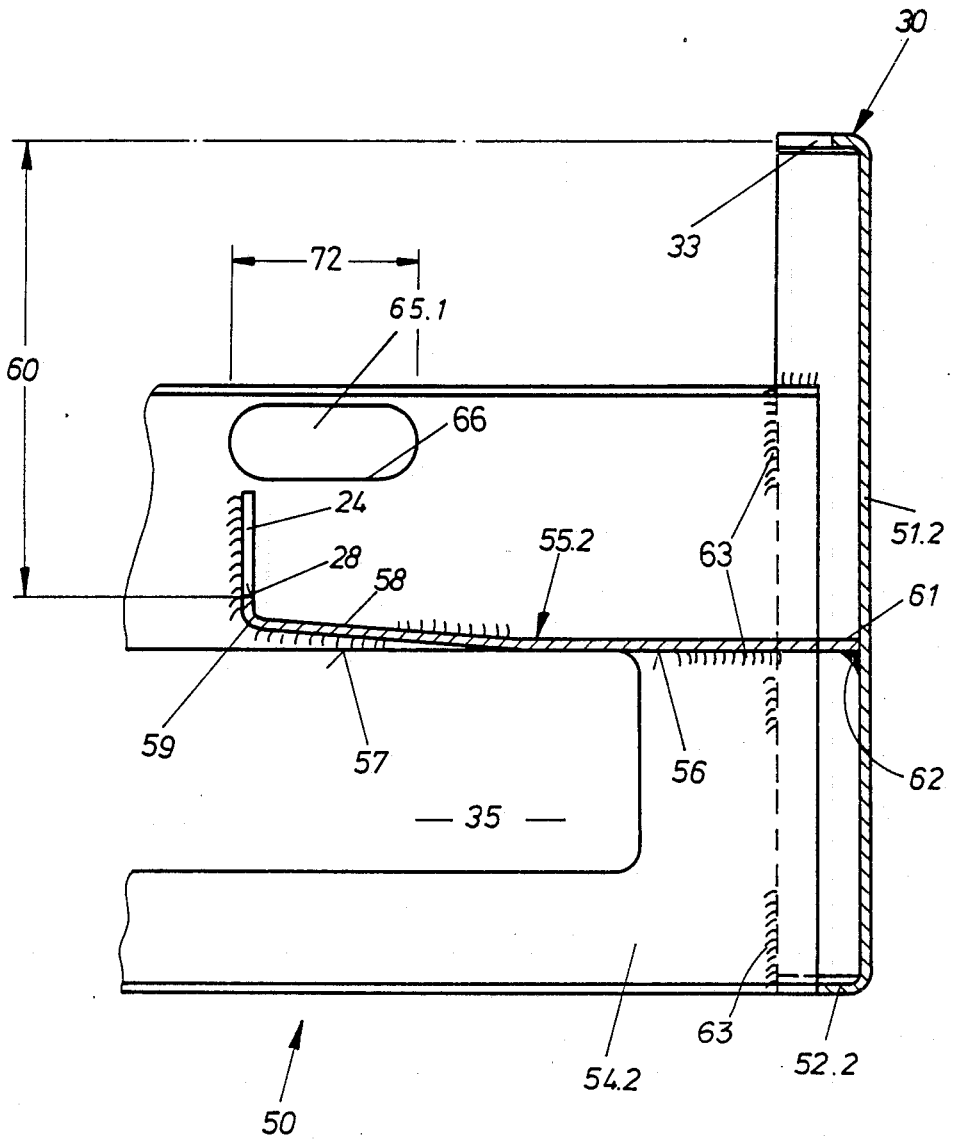
FIG. 7 is a fragmentary vertical sectional view through a rearward right-hand zone of the transport pallet of FIG. 6, approximately in a region of a line designated VII in FIG. 6.
Figure 8:
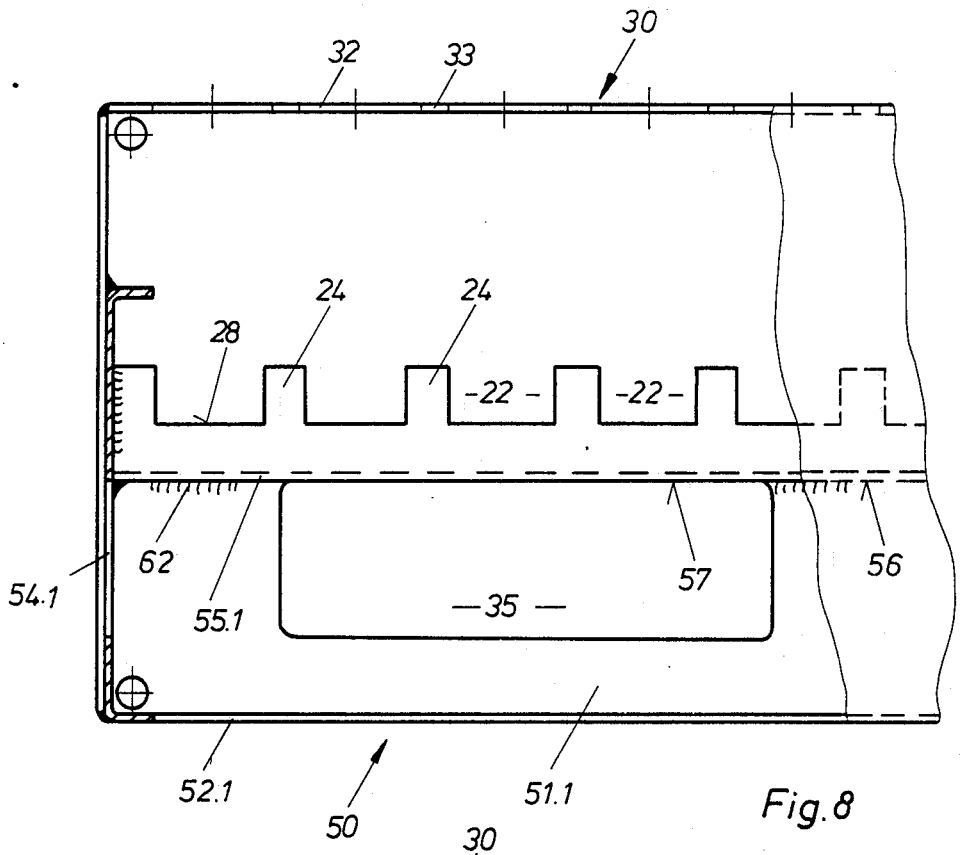
FIG. 8 is a vertical fragmentary sectional view of a forward left-hand corner zone, as viewed in a direction toward the holding rail.
Figure 9:
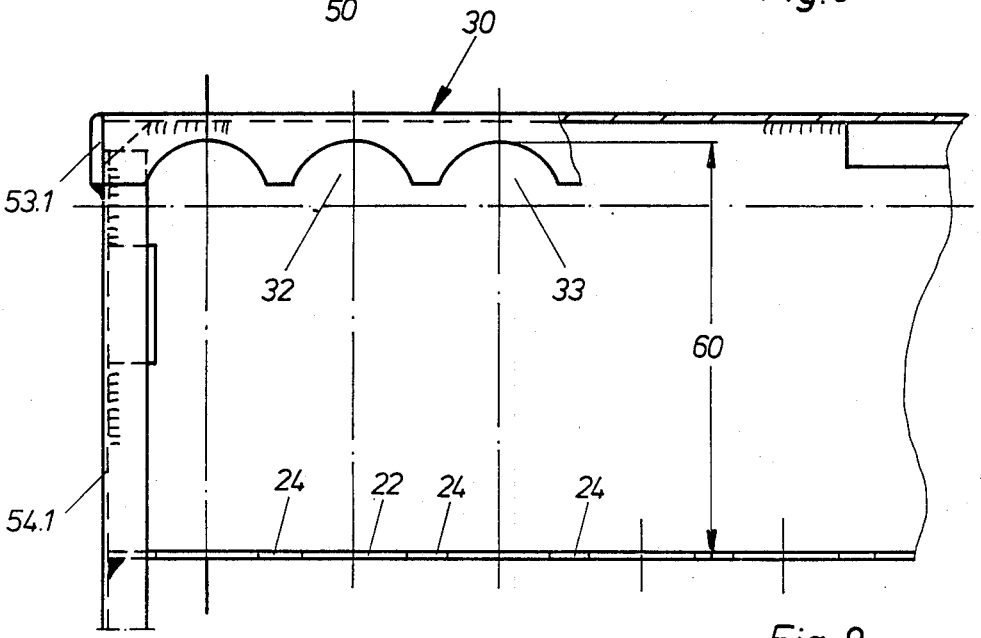
FIG. 9 is a partial top view of the forward left-hand corner zone without the holding rail.

All sidewalls, just as the longitudinal sidewalls of the embodiment of FIGS. 1–5, have fork cutouts 35 for the same purpose. However, the support of the forks of the forklifts is constructed somewhat differently, in that essentially horizontally extending holding and guide plates 55.1 and 55.2 are welded in place on the inside, namely, in such a manner that their bottom surfaces 56 are in alignment with the top edges 57 of the fork cutouts 35. In this arrangement, the plates extend, as shown in FIG. 7, over a large portion of the fork cutouts 35 formed in the end sidewalls 54.1 and 54.2 so that, no matter through which of the fork cutouts the forks are passed, the forks enter on the inside immediately beneath a relatively large supporting surface under which they can slide along without adhering to the rims of the fork cutouts 35 in the vertically sheet metal walls. The forward marginal zones 58 of the holding and guide plates 55.1 and 55.2 can be constructed so as to slope at least somewhat, as shown in FIG. 7, so that drainage of water can more readily proceed.

The bottom holding rails 29, projecting upwardly, are angled on the inner edges 59 of the holding and guide plated 55.1 and 55.2. As with the embodiment of FIGS. 1–5, the bottom holding rails 29 including gaging or holding recesses 22 and supporting surfaces 28, as well as interposed projecting holding teeth 24 for the same purpose. However, in the embodiment of FIG. 6–9, the holding teeth 24 are rendered to be somewhat more rugged by the bent shape of the proximate zone, than in the case of the embodiments of FIGS. 1-5, especially above the fork apertures or cutouts 35.

The spacing or distance 60 between the supporting surfaces 28 of the lower holding rails 29 and the upper lateral rack rails, corresponding to the distance A of the first embodiment (FIG. 4) of the embodiments of FIGS. 1–5, amounts in the embodiment of FIGS. 6–9 to about 12 cm; however, this spacing or distant can be in the range of between about 12 cm to about 25 cm.

The holding and guide plates 55.1 and 55.2 are welded, as shown in the drawings, on their edges 61 abutting the longitudinal sidewalls 51.1 and 51.2 on the inside in the longitudinal direction to the sidewalls by corner seams 62 (FIG. 7). Otherwise, they extend on the inside up to the end sidewalls 54.1 and 54.2 and are attached at those locations by weld seams 63 (FIG. 7). In this manner, a simple, rugged structure is obtained having satisfactory inside transverse reinforcement with a relatively low expenditure in material and processing labor.

Figure 6:
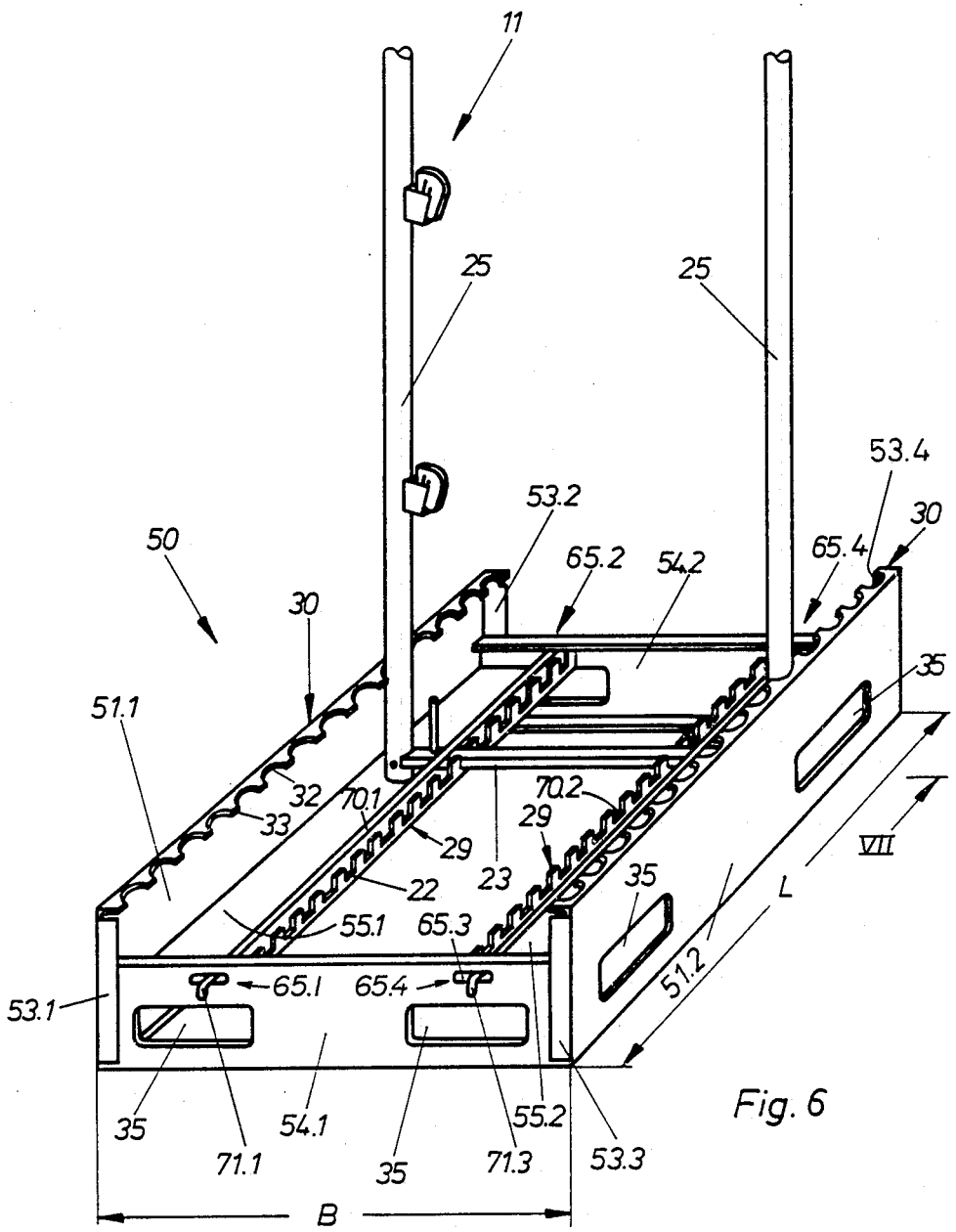
FIG. 6 is an oblique perspective view of another embodiment of a transport pallet constructed in accordance with the present invention with an inserted trestle frame and holding bars.

Each of the end sidewalls 54.1 and 54.2 include, directly above the bottom holding rails 29, two bearing cutouts generally designated by the reference numerals 65.1 and 65.4 formed as slotted holes, with a spacing or distance from the supporting surfaces 28 being selected so that there is precisely a space from a bottom cross connection 23 between their bottom edges 66 (FIG. 7) and the supporting surfaces 28. The bearing cutouts 65.1, 65.4 serve for receiving holding bars 70.1, 70.2 passed in parallel to the rack rails 30 through the bearing bores 65.1, 65.2, respectively. The holding bars 70.1, 70.2 are fashioned, for example, as round bars having a total length of the transport pallet 50 and include at their ends bent safety hooks 71.1, 71.3 pointing in opposite direction, with a width of the slotted-holed bearing bores 65.1, 65.4 corresponding to a length of the safety hooks 71.1, 71.3. While only two safety hooks 71.1, 71.2 are shown in FIG. 6, it is understood that tow additional safety hooks (not shown) are accommodated in the slotted-hole bearing bores generally designated by the reference numeral 65.2 and 65.3 in the end sidewall 54.2 with the ends of the two additional safety hooks being bent in the opposite direction to the corresponding bent end of the safety hook 71.1, 71.3.

After an insertion of all trestle frames 11, the two holding bars 70.1 and 70.2 are introduced with horizontally disposed safety hooks 71.1 and 71.3 and the oppositely disposed safety hooks (not shown) through the oppositely located bearing cutouts 65.1–65.4 in parallel to the rack rails 30. Due to the fact that the respective ends of the respective holding bars, 70.1 and 70.2 are bent in opposed directions, the holding bars 70.1, 70.2, when released, always assume a position secured against falling out.

The lower holding faces of the holding bars 70.1, 70.2 constructed so as to be linear, therefore are then positioned above the supporting surfaces 28 of the cross connections 23 at a spacing of a height of the top edges and, respectively, the thickness of the cross connections 23. Since they lie above the bottom cross connections 23 of the trestle frames 11, the trestle frames 11 are secured against a lift-off in the upward direction, and it is thus possible to bring suitable lifting means into engagement with the upper ends of the trestle frames 11, and the entire transport unit can be lifted coherently at the top so that conveyance problems are avoided, as they could arise upon abutment against the bottom zones of such a unit, for example, the perforation 43 of the embodiment of FIGS. 1–5, due to lability.

When no frames 11 are inserted in transport pallets 50, they can be stacked well and safely. For this purpose, protection against lateral shifting, corresponding to the stacking safety device in the first embodiment of FIGS. 1–5 can also be provided in the second embodiment according to FIGS. 6 to 9, and one can provide, for example, in each of the upper four corners, projecting pins into which the corresponding recesses in bottom protection legs 52.2 engage. Conversely, the pins can project downward. Such engaging elements can also be formed in the sheet metal by appropriate depressions, so that when the empty transportation pallets are stacked, there is a positive engaging connection that prevents lateral shifting of transport pallets located one above the other.

While I have shown and described several embodiments in accordance with the present invention, it is understood that the same is not limited thereto but is suspectable to numerous changes and modification as apparent to one of ordinary skill in the art, and I therefore do not wish to be limited to the details shown and described herein but intend to cover all such modification as our encompass by the scope of the appended claims.

I claim:

1. A conveying system for transporting and storage of trestle frames of scaffolds, to be utilized in an upright position, the system comprising scaffold poles, a lower platform frame of sheet material having receiving means for receiving forks of forklift and holding means for retaining the trestle frames in an upright position, wherein the holding means for retaining the trestle frames in an upright position includes a pair of lower holding rails having a plurality of toothed means for engagement with a side of lower ends of the scaffold poles and lower cross connection means of the scaffold poles, and upper lateral holding rack rails lying above the lower holding rails, said upper lateral holding rack rails including inwardly directed lateral rack teeth defining therebetween holding recess means for respectively accommodating the scaffold poles, said lateral rack teeth being arranged in such a manner that an inner spacing of the holding recess means corresponds to an outer spacing of the scaffold poles, and wherein lower ends of the scaffold poles are disposed between the inner surface of the lower holding rails and an inner surface of the upper lateral holding rack rails.

2. A conveying system according to claim 1, wherein frame connections are provided at respective end sides of the platform frame, each frame connection including one upper end holding plate, and lower longitudinally extending supports, said lower longitudinally extending supports being formed as upwardly open essentially U-shaped box rails having fork receiving apertures extending through vertically extending walls thereof.

3. A conveying system according to claim 2, wherein the toothed means of the lower holding rails are formed as rectangular tenons.

4. A conveying system according to claim 3, wherein the rectangular tenons are formed by punching out holding recesses along rims of the vertically extending walls of the longitudinally extending supports.

5. A conveying system according to one of claims 1 or 2, wherein the upper lateral holding rack rails are fashioned as separately produced longitudinal support components having a U-shaped profile, and wherein upper horizontal legs of the upper lateral holding rack rails are constructed so as to open toward an inside of the platform frame, said upper lateral holding rack rails are provided with closely juxtaposed holding recesses forming said inwardly pointing lateral rack teeth.

6. A conveying system according to claim 5, wherein the upper lateral holding rack rails are bent into a U-shaped profile.

7. A conveying system according to claim 5, wherein the upper lateral holding rack rails are formed from U-shaped profile members.

8. A conveyor system according to claim 5, wherein said holding recesses are shaped as divided circles.

9. A conveying system according to claim 8, wherein said divided circles have a diameter substantially corresponding to a diameter of the scaffold poles.

10. A conveying system according to claim 2, wherein the upper end holding plates are welded with lower lateral end zones thereof at an end face in front of the lower longitudinal supports and are welded in a zone of upper outward corners thereof at an end face in front of the upper profile holding rails.

11. A conveying system according to claim 10, wherein vertically connectors are provided between the lower longitudinal supports and the upper profile holding rails.

12. A conveying system according to claim 5, wherein the upper end holding plates include, in a region of ends thereof, perforations for enabling engagement with at least one of hooks, ropes, and chains.

13. A conveying system according to claim 2, wherein the upper end holding plates include recess means in a center thereof for reducing a weight thereof, and at least a central grasping aperture means for enabling a manual transport.

14. A conveying system according to claim 13, wherein at least one identical central cross support means is provided at a distance from lower cross struts provided at respective ends of the longitudinally extending supports, said distance corresponding to a length of forks of the forklift.

15. A conveying system according to claim 14, wherein the longitudinally extending supports each include at least one longitudinally extending outwardly rounded supported rib formed by a double bending.

16. A conveying system according to claim 15, wherein said at least one longitudinally extending outwardly rounded supporting rib is provided along an outward bottom zone of the respective longitudinally extending supports.

17. A conveying system according to claim 15, wherein a top portion of outer walls of each of the longitudinally extending supports include reinforcing legs bent twice toward an inside of the longitudinal extending supports.

18. A conveying system according to one of claims 1, 2, 3, or 4 wherein the lower platform frame is formed of a steel sheet material.

19. A conveying system according to one of claims 2 or 3, wherein vertical connectors are provided between the lower longitudinal supports and the upper lateral holding rack rails.

20. A conveying system according to claim 2, wherein the upper end holding plates are welded with lower lateral end zones thereof at an end face in front of the lower longitudinal supports and are welded in a zone of upper outward corners thereof at an end face in front of the upper lateral holding rack rails.

21. A conveying system according to one of claims 1, 2, 3, or 4, wherein at least one identical central cross support means is provided at a distance from lower cross struts provided at respective ends of the longitudinally extending supports, said distance corresponding to a length of forks of the forklift.

22. A conveying system according to one of claims 1, 2, 3, or 4, wherein the longitudinally extending supports include at least one longitudinally extending outwardly rounded supporting rib formed by double bending.

23. A conveying system according to claim 22, wherein said at least one longitudinally extending outwardly rounded supporting rib is provided along an outward bottom zone of the respective longitudinal extending supports.

24. A conveying system according to claim 22, wherein a top portion of outer walls of each of the longitudinally extending supports includes reinforcing legs bent twice toward an inside of the longitudinal supports.

25. A conveying system according to claim 1 wherein holding means are provided and adapted to be placed over the lower cross connection means and lie with lower holding faces thereof above supporting faces of the lower holding rails at a predetermined distance therefrom.

26. A conveying system according to claim 25, wherein said predetermined distance between the supporting faces of the lower holding rails and lower holding faces of the cross connection means corresponds to a height of upper edges of lower cross connection means.

27. A conveying system according to claim 25, wherein the holding means are formed as holding bars extending in a direction of the lower holding rails and the upper lateral holding rack rails.

28. A conveying system according to claim 27, wherein bearing bore means are provided for accommodating ends of the holding bars, said bearing bore means being formed in end sidewalls of the trestle frame.

29. A conveying system according to claim 28, wherein the holding bars include safety hook means and respective ends thereof, said safety hook means being bent so as to point in opposite directions, and wherein the bearing bore means are formed in end sidewalls as horizontally extending slotted holes having a size sufficient to accommodate the safety hook means.

30. A conveying system according to claim 29, wherein the lower holding rails include longitudinally extending sidewalls bent upwardly along inner edges of holding and guide plates extending up to the longitudinally extending sidewalls and running substantially horizontally, and wherein bottom surfaces of the holding and guide rails extend at a level of cutouts provided for forks of a forklift.

31. A conveying system according to claim 30, wherein the longitudinally extending sidewalls include at upper edges thereof the inwardly directed lateral rack teeth and at lower edges thereof bent-away bottom supporting legs, and wherein the holding and guide plates are welded in place directly above the cutouts.

32. A conveying system according to claim 31, wherein the end sidewalls are inserted between end side legs bent at an end side away from the longitudinally extending sidewalls and are welded to the side legs.

33. A conveying system according to claim 1, wherein holding means are provided for holding the scaffold poles in an upright position, said holding means including holding bars extending in a direction of the lower holding rails and the upper lateral holding rack rails.

34. A conveying system according to claim 33, wherein bearing bore means are provided for accommodating ends of the holding bars, said bearing bore means being formed in end sidewalls of the trestle frame.

35. A conveying system according to claim 34, wherein the holding bars includes safety hook means at respective ends thereof, said safety hook means being bent so as to point in opposite directions, and wherein the bearing bore means are formed in the end sidewalls as horizontally extending slotted holes having a size sufficient to accommodate the safety hook means.

36. A conveying system according to claim 35, wherein the lower holding rails include longitudinally extending sidewalls bent upwardly along inner edges of holding and guide plates extending up to the longitudinal extending sidewalls and running substantially horizontally, and wherein bottom surfaces of the holding and guide rails extend at a level of top edges of cutouts provided for forks of a forklift.

37. A conveying system according to claim 36, wherein the longitudinal extending sidewalls include at upper edges thereof the inwardly directed lateral rack teeth and at lower edges thereof bent-away bottom supporting legs, and wherein the holding and guide plates are welded and placed directly above the cutouts.

38. A conveying system according to claim 37, wherein the end sidewalls are inserted between end side legs bent at an end side away from the longitudinally extending side walls and are welded to the side legs.

39. A conveying system according to one of claims 1, 2, 3, or 4, wherein means are provided in at least one of an edge and corner area of at least one of an upper and lower surface of the trestle frame for aiding a stacking of the same.

40. A conveying system according to claim 39, wherein said stacking means are adapted to be brought into material engagement in a vertical direction and positively prevent lateral movement.

* * * * *